US012370461B1

(12) United States Patent
Wang

(10) Patent No.: US 12,370,461 B1
(45) Date of Patent: Jul. 29, 2025

(54) INTEGRATED BUILDING BLOCK

(71) Applicant: Shantou Chenghai Bricklayer Toys Co., Ltd., Shantou (CN)

(72) Inventor: Jin Wang, Shenzhen (CN)

(73) Assignee: Shantou Chenghai Bricklayer Toys Co., Ltd., Shantou (CN)

( * ) Notice: Subject to any disclaimer, the term of this patent is extended or adjusted under 35 U.S.C. 154(b) by 0 days.

(21) Appl. No.: 19/078,187

(22) Filed: Mar. 12, 2025

(30) Foreign Application Priority Data

Nov. 19, 2024 (CN) ..... 202422823624.5

(51) Int. Cl.
*A63H 33/04* (2006.01)

(52) U.S. Cl.
CPC ..... *A63H 33/042* (2013.01)

(58) Field of Classification Search
CPC ..... A63H 33/04; A63H 33/042; A63H 33/086
USPC ..... 446/91
See application file for complete search history.

(56) References Cited

U.S. PATENT DOCUMENTS 9,168,464 B2 * 10/2015 Karunaratne ..... A63H 33/042
10,069,316 B2 * 9/2018 Lin ..... H01R 24/22
11,612,827 B2 * 3/2023 Müller ..... A63H 33/086 446/91
11,726,942 B2 * 8/2023 Yi ..... H04L 12/403 710/104
12,021,394 B2 * 6/2024 Knights ..... A63H 33/086
12,029,996 B2 * 7/2024 Cecchin ..... A63H 33/22
12,090,419 B2 * 9/2024 Donaldson ..... A63H 33/26
12,121,827 B2 * 10/2024 Donaldson ..... A63H 33/086
12,251,645 B2 * 3/2025 Joshi ..... A63H 33/086
2006/0252340 A1 * 11/2006 Bach ..... G09B 23/10 446/124
2014/0127965 A1 * 5/2014 Adam ..... A63H 33/042 446/91
2014/0273711 A1 * 9/2014 Capriola ..... A63H 33/042 446/91
2016/0361662 A1 * 12/2016 Karunaratne ..... G06F 3/038
2019/0118110 A1 * 4/2019 Starling ..... A63H 33/042
2019/0232185 A1 * 8/2019 Lin ..... A63H 33/086
2023/0321557 A1 * 10/2023 Cho ..... A63H 33/22 439/74
2024/0293757 A1 * 9/2024 Lee ..... G06F 8/40
2024/0408506 A1 * 12/2024 Luo ..... H02J 50/10

* cited by examiner

*Primary Examiner* — Kurt Fernstrom
(74) *Attorney, Agent, or Firm* — Fideli Law PLLC; Qiang Li

(57) ABSTRACT

An integrated building block is provided and belongs to the field of toy products, which includes a battery pack formed by splicing an upper shell and a lower shell, wherein outer surfaces of an upper end and a lower end of the battery pack are respectively provided with plug-in convex points and plug-in concave points with matched sizes; a cavity is formed in the battery pack, and a power storage module and an expansion board are provided in the cavity; the power storage module is provided with a power supply interface on an outer surface of the battery pack by the expansion board, and the power supply interface is used to supply power to a corresponding electric module after being butted with other electric modules. The invention is improved in ease of use and overall aesthetics by integrating the battery pack, power storage module and expansion board into one structure.

10 Claims, 2 Drawing Sheets

INTEGRATED BUILDING BLOCK

RELATED APPLICATIONS

The present application claims the benefit of priority of Chinese Patent Application No. 202422823624.5, filed Nov. 19, 2024, and entitled "INTEGRATED BUILDING BLOCK," the entire content of which is incorporated herein by reference.

TECHNICAL FIELD

The present invention relates to the field of toy products, and in particular, to an integrated building block.

BACKGROUND ART

Currently, a building block toy lamp set on the market is usually composed of three parts: a building block piece, a battery pack, and an expansion board. These components are independent of each other, especially the battery pack and the expansion board, which need to be configured separately when in use. Although this design meets the basic functional requirements of building block toys, it also presents some obvious problems.

For the appearance of the product, the battery pack and expansion board are independent components, which cannot be well integrated into the overall structure of the building block toy. This separated design not only affects the appearance attractiveness of the building blocks, but also is more abrupt in the assembling process, lacks harmonious unity, and cannot meet the high-standard requirement of users on the appearance. Moreover, in terms of ease of use, a building block toy is often made up of many small parts, and a finished product is large and not easy to move. When a user wants to move or rearrange the building block toy, the battery pack and expansion board are separate components, which is inconvenient to carry and even affects the user experience.

In addition, the combination of such independent battery pack and expansion board also increases the cost. The lamp cords connecting the battery pack and the expansion board are relatively complicated, which easily leads to wiring confusion, increases the failure rate of the product, and puts higher requirements on after-sales service, thereby increasing the terminal cost of the product. Meanwhile, the exposed expansion board lacks protection measures and is easily affected by external factors, which poses potential safety hazards that may cause the lamp set and the expansion board to be burnt or damaged, affecting the overall service life.

In conclusion, the existing design of separating a battery pack and an expansion board of a building block toy has the problems of insufficient aesthetics, poor convenience, high cost, and low safety. Therefore, a new building block is urgently required in the market.

SUMMARY OF THE INVENTION

An objective of an embodiment of the present invention is provide an integrated building block, which aims to solve the problems of insufficient aesthetics, poor convenience, high cost and lower safety existing in the separated design of a battery pack and an expansion board of the existing building block toy.

To achieve the above objective, an embodiment of the present invention provides an integrated building block. The integrated building block includes: a battery pack formed by splicing an upper shell and a lower shell, wherein outer surfaces of an upper end and a lower end of the battery pack are respectively provided with plug-in convex points and plug-in concave points with matched sizes; a cavity is formed in the battery pack, and a power storage module and an expansion board are provided in the cavity; the power storage module is provided with a power supply interface on an outer surface of the battery pack by the expansion board, and the power supply interface is used to supply power to a corresponding electric module after being butted with other electric modules.

Optionally, a power supply circuit is arranged between the power storage module and the expansion board.

Optionally, screw posts arranged opposite to each other are provided in the upper shell and the lower shell and used to fix the upper shell and the lower shell after being spliced by screws.

Optionally, a surface of the expansion board is further provided with a light sensor opening; a light sensor is provided in the light sensor opening and serves as a trigger of a photosensitive switch; and the photosensitive switch is arranged on the expansion board and used to control the on-off of the power supply interface.

Optionally, a surface of the expansion board is further provided with a toggle switch outlet; a switch cap is provided in the toggle switch outlet, and the switch cap may be toggled along the toggle switch outlet and is used to trigger a manual switch; and the manual switch is arranged on the expansion board and used to cooperate with the photosensitive switch to control the on-off of the power supply interface.

Optionally, switch states of the manual switch at least include manual on, manual off and automatic; when the manual switch is set to on manually, the power supply interface is in a permanently on state; when the manual switch is set to off manually, the power supply interface is in a permanently off state; and when the manual switch is automatic, the on-off state of the power supply interface is triggered by the photosensitive switch.

Optionally, a surface of the expansion board is further provided with a charging hole; and the charging hole is provided with a charging interface connected to the power storage module and used to charge the power storage module when the charging module is electrically connected to the charging interface.

Optionally, a surface of the expansion board is further provided with an indicator light hole; and an indicator light is provided in the indicator light hole and used to indicate whether the power storage module is in a charging state or not through the on/off state.

Optionally, one or more power supply interfaces are provided; and the power supply interface is a puncture terminal female socket interface.

Optionally, a surface of the expansion board is further provided with at least one power supply interface hole; and each power supply interface extends out of a surface of the battery pack based on the power supply interface hole.

Through the above technical solution, the integrated building block is improved in the ease of use and overall aesthetics by integrating the battery pack, the power storage module and the expansion board into one structure. The design of plug-in convex points and plug-in concave points on the upper surface and the lower surface of the battery pack enables the battery pack to be seamlessly spliced with other modules like building blocks, so that the unified appearance of the product is achieved. Meanwhile, the cavity in the battery pack provides protection for the power storage module and the expansion board, so that the safety and the durability of the assembly are greatly improved. The power supply interface is arranged on the outer surface, so that the battery pack can be conveniently and quickly butted with other electric modules, multi-module synchronous power supply is supported, and the requirement of a building block toy user on function integration is met. This design simplifies the use process, improves the user experience, and is suitable for wide building block construction scenarios.

Additional features and advantages of the embodiment of the present invention are described in the subsequent detailed descriptions.

BRIEF DESCRIPTION OF THE DRAWINGS

The accompanying drawings are used to provide further understanding of the embodiment of the present invention and constitute a part of the specification. The accompanying drawings, in combination with the following specific implementations, are used to explain the embodiments of the present invention, but do not constitute a limitation on the embodiment of the present invention. In the drawings.

DESCRIPTIONS OF REFERENCE NUMERALS

10: battery pack; 20: expansion board; 30: power storage module;

101: upper shell; 102: lower shell; 103: plug-in convex point; 104: plug-in concave point; 105: light sensor; 106—manual switch; 107: indicator light;

201: power supply interface; and 202: charging interface.

DETAILED DESCRIPTION OF EMBODIMENTS

The following describes specific embodiments of the present invention in detail with reference to the accompanying drawings. It should be understood that the specific embodiments described herein are merely illustrations and explanations of the present invention and do not limit the present invention.

In an embodiment of the present invention, unless otherwise specified, orientation terms such as "up", "down", "left", and "right" generally refer to an orientation or position relationship based on the accompanying drawings, or an orientation or position relationship that the product of the present invention is usually placed when in use.

In addition, the terms "first", "second", and the like are merely intended for differentiated description, and should not be construed as an indication or an implication of relative importance.

Moreover, the terms "horizontal", "vertical", "suspended", and the like do not imply that the components are absolutely horizontal, vertical or suspended, but may be slightly inclined. For example, "horizontal" merely means that the direction is more horizontal than "vertical" and does not mean that the structure must be perfectly horizontal, but may be slightly inclined.

In addition, terms such as "approximately" and "basically" are intended to explain that the relevant content does not require absolute precision, but may have a certain deviation. For example, "approximately equal" does not just mean absolute equality. Since it is difficult to achieve absolute "equality" in actual production and operation processes, there is generally a certain deviation. Therefore, in addition to absolute equality, "approximately equal" also includes the above situation where there is a certain deviation. In this case, unless otherwise specified, terms such as "approximately" and "basically" are used in a similar manner to those described above.

In descriptions of the present invention, it should be further noted that, unless otherwise specified and limited, the terms "arrange", "mount", "interconnect" and "connect" should be understood in a broad sense. For example, a "connection" may be a fixed connection, a detachable connection, or an integrated connection; or may be a direct connection, an indirect connection through an intermediate medium, or an internal connection between two elements. Those of ordinary skill in the art may understand specific meanings of the foregoing terms in the present invention according to specific cases.

Figure 1:
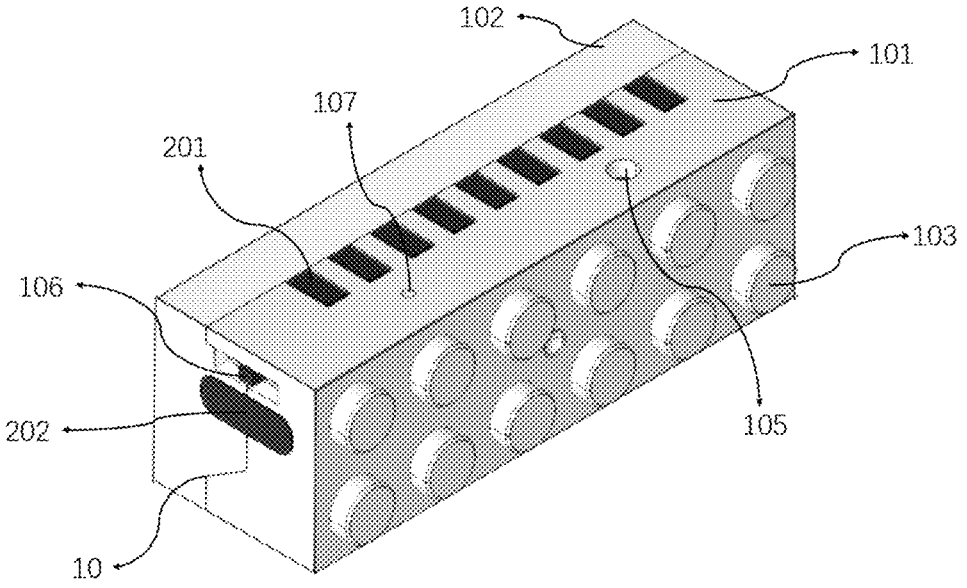
FIG. 1 is a schematic diagram of a structure of an integrated building block according to one embodiment of the present invention.

Referring to FIG. 1, this embodiment provides an integrated building block. The integrated building block includes: a battery pack 10 formed by splicing an upper shell 101 and a lower shell 102, wherein outer surfaces of an upper end and a lower end of the battery pack 10 are respectively provided with plug-in convex points 103 and plug-in concave points 104 with matched sizes; a cavity is formed in the battery pack 10, and a power storage module 30 and an expansion board 20 are provided in the cavity; the power storage module 30 is provided with a power supply interface 201 on an outer surface of the battery pack 10 by the expansion board 20, and the power supply interface is used to supply power to a corresponding electric module after being butted with other electric modules.

Figure 2:
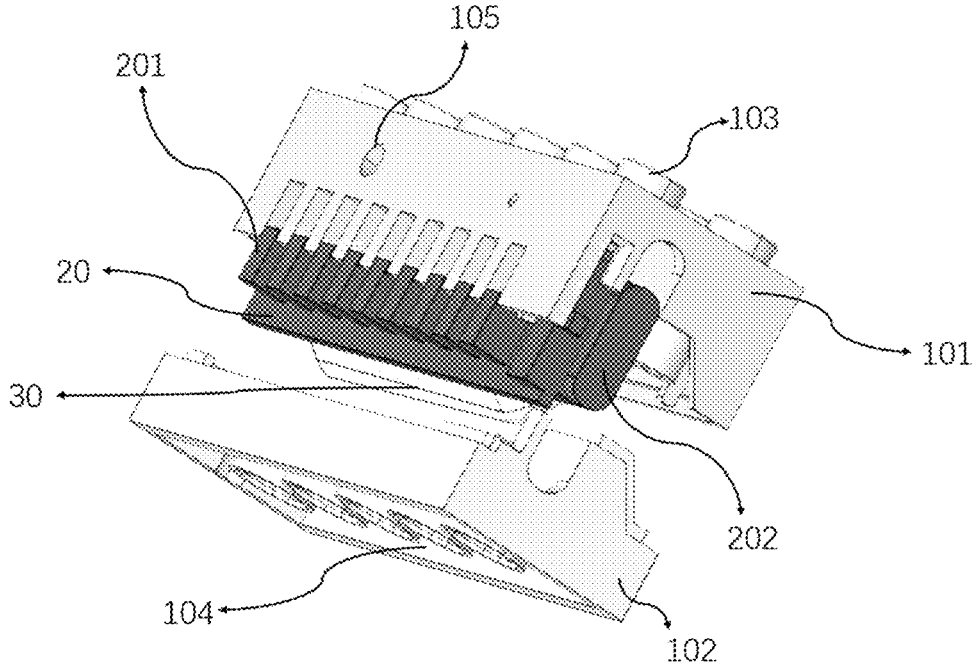
FIG. 2 is an exploded view of a structure of an integrated building block according to one embodiment of the present invention.

Preferably, as shown in FIG. 2, the plug-in convex points 103 and the plug-in concave points 104 are designed based on a standard regular building block, the upper shell of the battery pack 10 includes 12 circular protrusions with a diameter of 5 mm on a top, the lower shell includes 5 circular grooves with a diameter of 6.7 mm, and these convex cylinder and grooves adopt a standardized size and distribution method. The upper shell 101 and the lower shell 102 are precisely butted by these structures, so that the battery pack 10 can be not only stably spliced together but also be compatible with other building block modules. A user can use the battery pack 10 as a standard building block and splice this battery pack at different positions of a large building block structure. In a multi-layer building block model, the user places the battery pack 10 on the bottom of the building, and the protrusion design on the top allows the battery pack 10 to serve as a support base and be tightly combined with an upper building block module without becoming loose due to the weight or shaking of the model. This embodiment ensures the stability and compatibility of the battery pack 10 in various structures, and improves the reliability of building block splicing.

In another possible implementation, to improve the stability of stacking and assembling, the protrusion and groove surfaces of the battery pack 10 are specially treated with friction. Tiny textures are added on inner sides of the protrusion and groove, so that a larger friction force is formed when the two parts are spliced, and the spliced structure is enabled to be more compact and stable. This process ensures that the battery pack 10 is not easily detached from the other modules even in the case of frequent movement. For example, in constructing a mechanized building block model, the battery pack 10 is connected to a robot arm and a sensor module as a power supply module, and the battery pack 10 is ensured not to be loosened by vibration during the movement of the robot arm with the friction-enhanced protrusion and groove structure. This design is particularly suitable for a scenario in which a building block model needs to be frequently operated or transported, and improves the safety and stability of the module.

In another possible implementation, the protrusions and grooves of the battery pack 10 are designed as a buckling structure. A top of the protrusion is designed with a small embedding groove, the groove is provided with a protruding buckling edge, when the upper shell 101 and the lower shell 102 are spliced, the embedding groove of the protrusion and the buckling edge of the groove are tightly buckled, so that the two shells cannot be easily separated after being spliced. This design not only enhances the splicing stability, but also provides a solution that is convenient for users to disassemble and assemble. In an outdoor display scenario, after the user connects the battery pack 10 to other building blocks, there is no need to worry about accidental separation caused by wind or external force due to the stability of the buckling structure. This buckling design not only improves the tightness of the assembly, but also makes it easy for the user to disassemble and assemble modules based on a requirement, making it suitable for use in various environments.

In another possible implementation, the protrusion of the battery pack 10 is made of a flexible material, so that the protrusion has a certain elasticity during the splicing process. When the user splices the battery pack 10 with other modules, the flexible protrusion can adapt to slight angle changes, so that splicing is more flexible, and breakage or damage caused by slight dislocation or external force during splicing is avoided. This flexible design ensures a smooth experience during the building block assembly process and reduces the risk of damage caused by misoperation. When splicing complex building block models, the user can achieve stable connection of a plurality of modules by the flexible protrusions of the battery pack 10, and flexibly adjust the positions of the modules based on a requirement without damaging the whole structure. This design is suitable for building more complex building block models, and ensures that the user can achieve an easy operation and make a stable connection during installation and adjustment.

In another possible implementation, the groove design of the battery pack 10 is not only positioned at the bottom, but also auxiliary grooves are designed around the sides, so that the battery pack 10 can be spliced in multiple directions. The user can connect the battery pack 10 to other building block modules from either side, thereby constructing a more flexible structure. Each groove is designed with a standard diameter of 6.7 mm to ensure consistent matching with the top protrusion, maintaining a stable structural effect regardless of the direction of splicing.

When constructing a building block model that expands horizontally or vertically, the user connects the battery pack 10 to a module at the side. Through the provision of multi-directional grooves, the battery pack 10 can not only be used for power supply, but also serve as a structural support module, increasing the diversity and freedom of the model. The multi-directional connection design improves the assembly flexibility of the building block model, allowing users to freely construct complex structures based on a requirement.

Preferably, a power supply circuit is arranged between the power storage module 30 and the expansion board 20.

According to the embodiment of the present invention, in the design of the building block integrated with the expansion board 20 and the battery pack 10, the power storage module 30 is usually preferably a lithium battery because of high energy density, small size, and light weight, which is very suitable for the application of building block toys. However, the power storage module 30 may also use other types of batteries to meet specific usage requirements or enhance the functionality and durability of the product based on the requirements of different application scenarios.

1) Lithium battery: A lithium battery is currently the most widely used type of battery with high energy density and long cycle life, and thus is suitable for building block module applications that require long-term stable power supply. The lithium battery can be quickly charged through a Type-C interface, with high charging efficiency and convenient use. In addition, the lightness of the lithium battery also matches the assembly requirements of building block modules, allowing a user to easily integrate the battery pack 10 into the building block structure. The lithium battery also has certain temperature control capability, and can be matched with a temperature protection circuit to prevent the safety problem caused by overheating. The lithium battery is suitable for building block assembly scenarios that require long battery life and light weight, and can meet most daily application needs.

2) Nickel-metal hydride battery: When higher safety or cost control is required, the power storage module 30 may use a nickel-metal hydride (NiMH) battery. Compared with a lithium battery, the nickel-metal hydride battery has higher safety, relatively lower price and better environmental protection characteristic. Therefore, for some building block products with a lower budget or for children, the nickel-metal hydride battery is a preferred choice. Although the capacity of the nickel-metal hydride battery is inferior to that of the lithium battery, the nickel-metal hydride battery has certain advantages in temperature adaptability and cycle service life. The nickel-metal hydride battery is not easily damaged by overcharge or overdischarge, and can be used without a temperature control protection circuit, thereby simplifying the internal circuit structure of the battery pack 10 and reducing the cost.

3) Supercapacitor: In some applications that emphasize fast charging and discharging, a supercapacitor may be used as the power storage module 30. The supercapacitor has the advantages of ultrahigh power density and fast charging, and thus is very suitable for scenarios where high power output is required in a short period of time. For example, when a building block module is used to assemble a small electric vehicle model, the supercapacitor can provide high power output to an electric motor in a short period of time, achieving rapid acceleration and braking. In addition, the supercapacitor is charged extremely quickly and can be fully charged in a few minutes, greatly shortening the waiting time. Although the supercapacitor has a lower energy density than the lithium battery and a shorter battery life, the supercapacitor performs well in scenarios where frequent charging and high power output are required, and thus is suitable for some building block projects that are highly interactive and require high-frequency use.

4) Disposable battery (such as an alkaline battery): In some application scenarios, the battery pack 10 can be designed to use a disposable alkaline battery, which is particularly suitable for scenarios that do not require frequent use or have low power requirements. For example, when the battery pack 10 of the building block is used to display models or short-term exhibition projects, the alkaline battery can provide stable power support and can be directly replaced after use, which is easy to operate. In addition, the disposable battery does not require a charging interface 202 and a circuit design, thereby simplifying the structure of the battery pack 10 and reducing the cost. In some outdoor activities, short-term exhibition and demonstration or teaching presentation projects, the alkaline battery is an economical and convenient choice and meets the temporary power supply requirement.

5) Solar panel: For outdoor building block projects or applications that emphasize environmental protection, the battery pack 10 can integrate a small solar panel as the power storage module 30. The solar panel converts solar energy into electrical energy through the photovoltaic effect and stores the electrical energy inside the battery pack 10, and thus is suitable for use in an environment with abundant sunlight. For example, when the building block project is used for outdoor display, the solar panel can provide continuous power support for the building block module, reducing the dependence on the charging interface 202. Although the solar panel has low power output and long charging times, the solar panel is an ideal choice in environments where there is a long-term power supply demand and charging conditions are inconvenient.

6) Replaceable battery module: To improve the flexibility and adaptability of the battery pack 10 of the building block, a replaceable battery module can be designed to support the plug-in and replacement of various batteries such as a lithium battery, a nickel-metal hydride battery, and a supercapacitor. The user can choose the appropriate battery module for replacement based on an actual requirement. For example, a lithium battery can be chosen for long battery life in daily use, but can be replaced with a supercapacitor module for short-term projects with high power demands. This replaceable design makes the battery pack 10 of the building block more widely applicable and can meet various power demand scenarios.

Further, in the design of the building block integrated with the expansion board 20 and the battery pack 10, the core function of the power supply circuit is to ensure efficient power transmission between the power storage module 30 and the expansion board 20, provide stable output, and supply power to external devices such as a lamp set or other electronic modules. The power supply circuit not only supports basic power supply, but also can optimize the power supply effect, improve the energy efficiency and improve the use experience through various circuit design solutions. The most basic power supply circuit design is to connect a lithium battery and the expansion board 20 directly by two wires. The positive and negative electrodes of the lithium battery are respectively connected to the power supply ports on the expansion board 20. This design is simple and reliable, ensuring that the external module can directly obtain stable power from the lithium battery. This circuit is suitable for scenarios with low power supply requirements and simple power supply modes, and can meet the power requirements of general building block toy modules.

In another possible implementation, to increase the flexibility of the circuit, a bidirectional power supply circuit may be designed, so that the lithium battery can supply power to the external module through the expansion board 20 and can also be charged by the expansion board 20. For example, after the Type-C charging interface 202 is powered on by an external power source, the circuit conducts an external current to the lithium battery to achieve the power storage function. After the charging state ends, the circuit automatically switches back to the power supply mode. Such a bidirectional circuit design ensures convenience in use of the battery pack 10, and the user can complete conversion between charging and power supply without disassembling the battery pack 10.

In another possible implementation, in some module applications, different electronic modules may require different voltages to operate, and a voltage regulation function may be incorporated into the power supply circuit. The output voltage of the battery can be regulated to a voltage required by a specific module through a voltage regulator. For example, a lamp set may require a voltage of 5V, while some small motors may require a voltage of 3.3V. This design can be flexibly adapted to various external modules. In actual use, the user can select a required voltage by a toggle switch or an adjusting knob on the expansion board 20, which greatly increases the applicability of the battery pack 10.

In another possible implementation, a load detection function is designed in the power supply circuit, which can further improve the intelligence and power supply efficiency of the battery pack 10 of the building block. The circuit can detect the size of the connected load and automatically adjust the output power based on different conditions of the load. For example, when the connected load is detected to be a low-power device (such as a small LED lamp), the circuit reduces the output power to reduce unnecessary power consumption; and when the load is a high-power device (such as a small motor), the output power is automatically increased to ensure the normal operation of the device. The load detection power supply circuit can dynamically adapt to different power requirements, improving battery efficiency and battery life.

In another possible implementation, to support the simultaneous use of multiple modules, a split power supply circuit may be designed, that is, a plurality of independent power supply interfaces 201 are provided on the expansion board 20, each interface having an independent power supply path and switch control. This design ensures that the user can connect a plurality of modules simultaneously, and each module receives independent power support and does not interfere with each other. For example, three power supply interfaces 201 are designed to control the connected LED lamp, sensor and motor, respectively. By using split power supply, the user can flexibly control the switch of each circuit based on a requirement, realize the combined use of a plurality of modules, and avoid the situation where other modules are affected by power failure of one module.

In another possible implementation, to promote the user experience, the power supply circuit can add an automatic switching function, that is, when the lithium battery level is lower than a set value, the power supply circuit is automatically switched to a standby state, and the external module is prevented from working unstably due to insufficient battery level. For example, when the battery level is detected to be lower than 20%, the power supply circuit automatically cuts off the external power supply, and turns on the indicator light 107 to remind the user to charge. The automatic switching of the power supply circuit can prolong the service life of the battery while ensuring safety, making the battery pack 10 more intelligent.

Preferably, screw posts arranged opposite to each other are provided in the upper shell 101 and the lower shell 102 and used to fix the upper shell 101 and the lower shell 102 after being spliced by screws.

In an embodiment of the present invention, one or more opposite screw posts are provided on the upper shell 101 and the lower shell 102, and the user fixes the upper and lower shells 102 by the screws. The screws are connected by the screw posts to firmly lock the shell, ensuring the stability of the battery pack 10 in the use. This design is suitable for most common building block splicing applications, and can effectively prevent the battery pack 10 from loosening during the assembly and movement process, thereby improving the overall stability of the building block module. The standard screw fixation solution has the advantages of simple structure and convenient assembly, and can meet the basic requirements of most users.

In another possible implementation, when higher stability is required, a multi-screw distributed fixation solution can be used. Screw posts are provided at four corners of the upper shell 101 and the lower shell 102, and the shells are fixed by four screws. This design greatly increases the firmness of the shell connections and is suitable for larger and more complex building block modules, especially for scenarios that require higher-strength assembly and movement. For example, when the battery pack 10 of the building block is used as a central support module, a plurality of screws are used for fixing, so that the separation of the shells caused by load or misoperation can be effectively prevented. This distributed design also enhances the impact resistance of the battery pack 10 of the building block, ensuring that the battery pack remains stable during frequent disassembly and assembly.

In another possible implementation, to improve the accuracy during assembly process, positioning pins can be introduced based on screw fixation. The positioning pins are positioned next to the screw posts and are inserted into positioning holes of the upper and lower shells 102 to ensure that the two parts are aligned. The positioning pins and the screws are combined for use, so that more accurate installation can be achieved, and the problem of deviation caused by screw sliding is avoided. For example, when rapid installation is required, the design of the positioning pin can reduce human errors and ensure efficient and accurate installation. This combination is particularly suitable for mass production scenarios, which can not only improve assembly efficiency, but also improve product consistency and precision.

In another possible implementation, to enhance the installation experience of the user, a buckle auxiliary fixation structure may be designed in addition to the screw fixation. The edges of the upper shell 101 and the lower shell 102 are designed with mutually embedded buckle structures, so that when the upper and lower shells 102 are spliced, the shells can be fixed by buckles first and then reinforced by screws. The buckle fixation not only facilitates the rapid assembly of the user, but also enhances the stability of the assembly, so that the shells cannot easily fall off even if the screws are loosened. For example, the child building block toy can simplify the installation process and improve the safety by using this design. This combined fixation structure is more suitable for scenarios where disassembly and assembly are often required, which prolongs the service life of the product.

In another possible implementation, in some scenarios where long-term fixation is required and frequent disassembly and assembly are inconvenient, an adhesive can be used for auxiliary fixation based on screw fixation. The adhesive can be applied around the screw posts to enhance the adhesion of the screws to the shells, thereby further increasing the strength of the structure. For example, in outdoor building block display scenarios, adhesive-assisted fixation can effectively prevent screws from loosening due to environmental changes or vibrations, ensuring stability during long-term use. This design is suitable for scenarios that do not require repeated disassembly and assembly, performs particularly well in outdoor environments, and can withstand external interference such as wind and rain.

In another possible implementation, to facilitate subsequent maintenance and replacement, a detachable nut fixation structure may be designed. By adding nuts to upper ends of the screw posts, the user can remove or replace the upper and lower shells 102 at any time based on a requirement, thereby increasing the flexibility of the battery pack 10 of the building block. For example, when the battery module needs to be replaced or the interior needs to be cleaned, the detachable nut structure enables the upper and lower shells 102 to be quickly opened, making it convenient for the user to perform maintenance. This design is suitable for scenarios where periodic maintenance is required and provides a more convenient user experience.

Preferably, a surface of the expansion board 20 is further provided with a light sensor 105 opening; the light sensor 105 is provided in the light sensor 105 opening, and the light sensor 105 serves as a trigger of a photosensitive switch; and the photosensitive switch is arranged on the expansion board 20 and used to control the on-off of the power supply interface 201.

Preferably, a surface of the expansion board 20 is further provided with a toggle switch outlet; a switch cap is provided in the toggle switch outlet, and the switch cap may be toggled along the toggle switch outlet and is used to trigger a manual switch 106; and the manual switch 106 is arranged on the expansion board 20 and used to cooperate with the photosensitive switch to control the on-off of the power supply interface 201.

Preferably, switch states of the manual switch 106 at least include manual on, manual off and automatic; when the manual switch 106 is set to on manually, the power supply interface 201 is in a permanently on state; when the manual switch 106 is set to off manually, the power supply interface 201 is in a permanently off state; and when the manual switch 106 is automatic, the on-off state of the power supply interface 201 is triggered by the photosensitive switch.

In the design of the integrated building block, the surface of the expansion board 20 is integrated with a light sensor 105 opening, a toggle switch outlet and a variety of switch control methods, so that the battery pack 10 can automatically control the on-off of the power supply interface 201 based on an external light condition, and greatly improves the convenience and intelligence of user use. The following is a detailed description of each embodiment, which shows the specific implementation and functional effects of different control modes in various application scenarios.

Embodiment 1: Automatic on/Off Mode Controlled by a Light Sensor 105

In this embodiment, a light sensor 105 opening is formed on the surface of the expansion board 20, and the light sensor 105 is provided in the opening. The light sensor 105 serves as a trigger of the photosensitive switch, and when the intensity of the external light changes, the light sensor 105 can automatically adjust the on/off of the power supply interface 201. Specifically, when the external light is strong (such as during the day or in a lighted environment), the light sensor 105 triggers the photosensitive switch to cut off the power supply interface 201, so as to prevent the battery pack 10 from supplying power to unnecessary modules, thereby achieving the power saving effect. When the ambient light is weak (such as at night or in a dark room), the light sensor 105 automatically triggers the photosensitive switch to connect the power supply interface 201 to supply power to the lighting module in the building block toy.

The design of this automatic switch mode enables the battery pack 10 of the building block to autonomously control the power supply state based on environmental changes, and the user can achieve intelligent lighting effects without manual operation. For example, when a user constructs a house or a city model, the battery pack 10 can automatically control a light module, so that the model can automatically light up at night and automatically close during the day, and the fun and interactivity of the model are increased.

Embodiment 2: Combined Control of a Manual Switch 106 and a Photosensitive Switch In this embodiment, the expansion board 20 is not only provided with the light sensor 105, but also provided with a toggle switch outlet, and a switch cap is installed in the toggle switch outlet, so that the user can manually slide the switch cap to control the on/off of the power supply interface 201. The manual switch 106 is designed to be used in combination with the photosensitive switch. By manually controlling the setting of the priority, the user can more flexibly select the working mode of the battery pack 10.

Specifically, when the manual switch 106 is set to the "manual on" state, the power supply interface 201 is always connected, and the power supply interface 201 is not automatically turned off even if the light sensor 105 detects bright light; when the manual switch 106 is in a "manual off" state, the power supply interface 201 is always turned off and is not affected by the light sensor 105; and when the manual switch 106 is in the "automatic" state, the state of the power supply interface 201 is controlled by the photosensitive switch, so as to achieve the automatic on-off effect.

For example, when the user sets the manual switch 106 to the "manual on" state, it is ensured that the lighting module is continuously powered on in a specific display or photographing scenario, so as to avoid a power failure condition caused by light change; and when the user sets the manual switch to the "manual off" state, the battery pack is suitable for scenarios where power saving is required, and the user can directly and manually close the power supply of the battery pack 10 to prevent unnecessary power consumption. This design of the manual and automatic combined control increases the autonomy and control flexibility of the user.

Embodiment 3: Control of a Multi-Level Manual Switch 106

This embodiment adds multiple levels of control to the manual switch 106, including five states: "manual on", "manual off", "automatic", "low brightness", and "high brightness". In addition to basic manual on, manual off and automatic control, the user can switch between "low brightness" and "high brightness" based on a requirement to adjust the brightness of the light set to which the power supply interface 201 is connected.

In this design, the "low brightness" mode can reduce the output power of the power supply interface 201, which is suitable for scenarios at night or creating a soft atmosphere; and the "high brightness" mode provides full power output, which is suitable for scenario with higher lighting requirements. This multi-level manual switch 106 satisfies the flexible adjustment of the user under different brightness requirements. For example, in the night light setting of the children's bedroom, the building block lamp set can be adjusted to low brightness mode to provide a warm and soft light source; while in the model display, the building block lamp set is switched to high brightness mode to make the model details more clearly visible. This design further improves the practicality and user experience of the battery pack 10 of the building block.

Embodiment 4: Combined Control of a Timer and a Photosensitive Switch

This embodiment introduces a timer function that allows the battery pack 10 to enable or disable the power supply interface 201 for a specific period of time by cooperating with a photosensitive switch. Specifically, the user can preset the power supply time period, for example, between 6 μm and 10 μm, the light sensor 105 automatically controls the on-off of the power supply interface 201 based on the light intensity; outside the set time, the power supply interface 201 remains the off state regardless of the light intensity.

This design of combined control of the timer and the photosensitive switch is suitable for some scenarios with periodic lighting requirements. For example, in a model exhibition hall, the user can preset the power supply time, automatically turn on the lights during the exhibition, and turn off the lights after the exhibition, thereby saving electricity and reducing maintenance costs. This timing control not only improves the automation level of the battery pack 10, but also makes it have higher application value in specific commercial scenarios.

Embodiment 5: Motion Sensing Control

In this embodiment, a motion sensor is further added to the expansion board 20, and the motion sensor and the photosensitive switch together control the power supply interface 201. The motion sensor can detect external motion or vibration and trigger the power supply interface 201 when detected. This function is mainly used in highly interactive building block assembly scenarios to ensure that the building block model only lights up when someone approaches or touches this model, thereby improving the interactive effect.

For example, in a building block assembly display, the model only lights up when someone approaches, and the power consumption is effectively reduced while the model is displayed. For children's toy applications, the introduction of the motion sensor can allow building blocks to automatically light up when children approach, providing a more interesting playing experience. This design further enriches the functionality of the battery pack 10, enabling it to adapt to more dynamic usage environments.

Preferably, a surface of the expansion board 20 is further provided with a charging hole; and the charging hole is provided with a charging interface 202 connected to the power storage module 30 and used to charge the power storage module 30 when the charging module is electrically connected to the charging interface 202.

In an embodiment of the present invention, a Type-C interface female socket is provided on the expansion board 20, and the interface is connected to an internal lithium battery through two wires for charging the battery pack 10. The Type-C interface is designed to be installed at a right side edge of the battery pack 10 and exposed through the charging hole of the shell, and the user only needs to insert the Type-C charging cable into the interface, so that the battery inside the battery pack 10 can be charged. The Type-C interface supports the bidirectional charging technology, so that the charging efficiency is higher, meanwhile, this Type-C interface adapts to a variety of standard charging cables and power adapters, and the charging requirements of the user in different environments are met. The charging design of the Type-C interface has the characteristics of high universality and high charging, and is particularly suitable for the use requirements of daily building block toys. With this design, the user can charge the battery pack 10 at any time at home or outdoors using a common Type-C charging cable without a dedicated charging device, which increases the portability and ease of use of the battery pack 10.

In another possible implementation, a wireless charging module is installed on the back of the expansion board 20 and is compatible with mainstream wireless charging protocols, such as the Qi standard. When the user places the battery pack 10 on a wireless charging base, the wireless charging module automatically docks with the base to charge the internal lithium battery. This design eliminates the need for the user to plug and unplug charging cables for charging, greatly improving the user experience. Meanwhile, the wireless charging design can reduce the abrasion of the interface of the battery pack 10 and prolong the service life of the device. This wireless charging solution is very suitable for building blocks that need to be charged frequently, especially in display scenarios. When placed for a long time, the battery pack 10 can be continuously charged through the wireless charging base to ensure the continuity of the display effect. For example, in a building block-themed exhibition, a wireless charging base can be hidden under the booth, so that the building block models on display are always kept charged without manual intervention.

In another possible implementation, a magnetic charging interface 202 is embedded in the charging hole of the expansion board 20. The end of the charging cable is also magnetic, and the user only needs to place the charging cable close to the charging hole, and the interface automatically adsorbs and docks, allowing for fast and convenient charging operations. The magnetic charging interface 202 adopts a fool-proof design, and the user can adjust the direction at will without precise alignment, and charging starts immediately. In addition, the magnetic design prevents the interface from loosening when the user pulls the cable, thereby effectively protecting the integrity of the charging interface 202. This magnetic charging design is particularly suitable for child building block toy scenarios. Children may not be able to accurately insert the traditional charging cable while playing, but the magnetic design can help them easily complete the charging operation, improve the convenience of use, and does not easily damage the device when accidentally pulled. This design extends the service life of the device and also enhances the safety of the battery pack 10.

In another possible implementation, a small solar panel is installed on the surface of the expansion board 20, and the solar panel is connected to the power storage module 30, so that the solar panel can directly use sunlight to charge the internal battery. The solar panel is exposed on the upper part of the battery pack 10 and can be charged by natural light in an outdoor environment. During the charging process, the battery pack 10 does not need to be connected to a power cord, and only needs to be placed in an area with sufficient light, and the solar panel continues to charge the internal power storage module 30. This design of the solar charging interface 202 is very suitable for outdoor building block usage scenarios. For example, during outdoor activities, the battery pack 10 can provide sustainable power support for modules such as building block lamp sets and sensors without having to worry about running out of power. This design is not only environmentally friendly, but also reduces dependence on external power sources, making it a charging method suitable for outdoor and low-power usage scenarios.

In another possible implementation, a Micro-USB interface is embedded in the charging hole of the expansion board 20 and is connected to the internal battery. The Micro-USB is used as a common charging interface 202, and can help a user to use a non-Type-C charging cable for emergency charging on a special occasion. This design mainly takes into account the compatibility requirements of the battery pack 10 in specific situations to cope with unexpected scenarios where there is no Type-C charging cable. This emergency charging design is suitable for scenarios where building blocks are used for a long time. For example, during a long outdoor display, if the Type-C cable fails or is lost, the user can still use a Micro-USB cable to charge the battery pack 10 to ensure the continuous power supply requirements of the battery pack 10. This design enhances the versatility of the battery pack 10 and adapts to usage requirements in various scenarios.

In another possible implementation, the surface of the expansion board 20 is provided with both Type-C and Micro-USB interfaces. The Type-C interface is used for fast charging, while the Micro-USB interface serves as a backup charging mode. When the Type-C interface is plugged in, the system defaults to charging from the Type-C interface. When the Type-C interface is not plugged in, the Micro-USB interface can be used as an emergency charging port. This dual-interface design provides the user with more charging options, ensuring that the battery pack 10 can be charged in time in any scenario. This dual-interface combined charging design improves the charging adaptability of the battery pack 10. In a specific situation, the user may select a suitable charging interface 202 based on an existing condition, for example, the charging requirements can be met in different environments such as a company, a home, and outdoors. The flexibility of this design makes the battery pack 10 more adaptable, reduces dependence on specific charging cables, and makes it convenient for the user to charge the battery pack 10 anytime and anywhere.

In another possible implementation, the charging interface 202 on the expansion board 20 is equipped with an intelligent management module that can detect the charging voltage and current and adjust the charging speed based on a battery level. When the battery level is low, the intelligent management module can accelerate the charging speed; and when the battery level is about to be fully charged, the charging speed can be automatically reduced so as to protect the battery and prevent overcharging. The intelligent management module can also monitor the charging temperature, if the temperature is too high, the system can automatically stop charging, and the safety problem caused by charging overheating is avoided. The management and design of the intelligent charging interface 202 is suitable for a long-time use scenario, and the service life of the battery is prolonged. For example, when charging at night, the user can connect the battery pack 10 to a charging source, and the intelligent management module automatically controls the charging progress to ensure that the battery is fully charged under safe conditions. This design not only improves charging efficiency, but also enhances charging safety, and is suitable for the user who has higher requirements for battery life.

Preferably, a surface of the expansion board 20 is further provided with an indicator light 107 hole; and an indicator light 107 is arranged in the indicator light 107 hole, and the indicator light 107 is used to indicate whether the power storage module 30 is in a charging state or not through the on/off state.

In an embodiment of the present invention, in the design of the building block integrated with the expansion board 20 and the battery pack 10, a special indicator light 107 hole is further formed on the surface of the expansion board 20, and the indicator light 107 is embedded therein for displaying the charging state of the power storage module 30. The indicator light 107 displays different on and off states based on the charging status of the battery pack 10, so that the user can understand the charging status of the battery in real time. This design not only simplifies the user's judgment of the charging process, but also increases the operability and user experience of the battery pack 10. The indicator light 107 informs the user whether the battery is being charged by a simple on-off change. When the battery pack 10 is connected to a charger and the power storage module 30 is charging, the indicator light 107 is turned on to intuitively remind the user that the charging process is in progress; when the battery is fully charged, the indicator light 107 is turned off to remind the user that charging is complete to avoid overcharging. This design is particularly suitable for the user who is more concerned about the battery status, making the battery pack 10 more convenient and safer during use. The user does not need to check the charging device every time, and can know whether charging is complete or not only by observing the state of the indicator light 107.

Based on the solution of the present invention, the user can directly check the charging progress of the battery without opening the battery pack 10 or additional devices, so that the use convenience is improved. The indicator light 107 not only enables the user to effectively manage the charging time, avoids battery loss caused by connecting the charger for a long time, but also enhances the safety and reliability of the device. Meanwhile, this intuitive state display method makes the battery pack 10 more user-friendly and convenient for use in various scenarios, and is particularly suitable for various scenarios such as child building block toys and display building block models.

Preferably, one or more power supply interfaces 201 are provided; and the power supply interface 201 is a puncture terminal female socket interface.

Preferably, a surface of the expansion board 20 is further provided with at least one power supply interface 201 hole; and each power supply interface 201 extends out of a surface of the battery pack 10 based on the power supply interface 201 hole.

Figure 3:
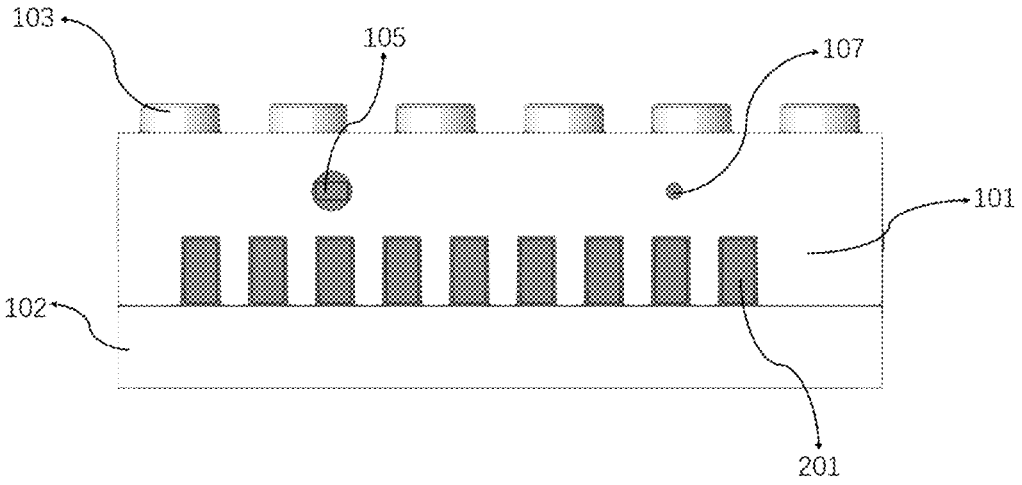
FIG. 3 is a front view of a structure of an integrated building block according to one embodiment of the present invention.

In an embodiment of the present invention, as shown in FIG. 3, 9 2P 0.8 mm puncture terminal female socket interfaces are designed on the surface of the expansion board 20, and each power supply interface 201 is connected to the battery module through an independent power supply line. The 9 interfaces are uniformly distributed around the expansion board 20 and extend out of the surface of the battery pack 10 through the power supply interface 201 hole, so that the user can easily connect a plurality of modules, such as an LED lamp set, a motor, and a sensor. The design has the advantages of achieving simultaneous power supply of a plurality of modules, keeping the interface compact and being convenient to operate. In the model display, the user can connect a plurality of light sets through 9 power supply interfaces 201 to provide uniform lighting for different areas of the large building model, thereby creating a more realistic effect. Meanwhile, this design also makes it easy for the user to adjust the number and position of modules based on a requirement. For example, when a small robot is constructed, 9 power supply interfaces 201 can be connected to a wheel motor, a sensor and a control module, so that more flexible function combination is achieved.

In another possible implementation, 3 groups of power supply interfaces 201 are designed on the surface of the expansion board 20, each group including 3 2P 0.8 mm puncture terminal female socket interfaces. Each group of interfaces is powered independently, and the power supply status of each group of interfaces can be switched by toggling a switch or a control button, allowing the user to flexibly control the operation of a plurality of modules. Each group of power supply interfaces 201 extend out of the surface of the battery pack 10 through the power supply interface 201 holes and are distributed on different sides to reduce the crossing of power supply lines. This design of the grouped power supply interface 201 is particularly suitable for the zone control scenario. For example, in a multifunctional building block vehicle model, a first group of interfaces can be connected to headlights and taillights, a second group of interfaces are used to connect to a control system, and a third group of interfaces are connected to a sensor module. The user can control the power supply status of each module based on a requirement to avoid unnecessary power consumption. This grouped control method improves the battery life and makes the functions of the building block model more diverse and practical.

In another possible implementation, the expansion board 20 is provided with only one puncture terminal female socket interface with a high power supply capacity, which is dedicated to providing a high power output for modules requiring a large amount of power. The interface is positioned at the center of the expansion board 20 and is connected to the battery module through a thickened power supply line to ensure stable high power output. This single-interface high-power power supply design is suitable for scenarios that need to drive large components or high-power accessories. For example, when a large-scale robot arm model is constructed, the high-power power supply interface 201 is connected to a main motor to provide sufficient power to drive the operation of the robot arm. The high power design ensures the smooth operation of the motor and does not cause performance degradation due to insufficient power. This embodiment simplifies the number of power supply interfaces 201 and improves the output performance of a single interface, enabling the battery pack 10 to support power-intensive modules.

In another possible implementation, a double-row power supply interface 201 matrix is designed on the expansion board 20, and is composed of 16 2P 0.8 mm puncture terminal female socket interfaces to form a 4×4 matrix arrangement, and each interface is independently connected to a battery module and evenly distributed on two rows of the expansion board 20. The double-row design reduces the interference between the interfaces and ensures the stable power output between the interfaces. The matrix interface design is suitable for achieving a multi-point power supply scenario in a building block construction model. For example, in an urban scenario, the user can connect the power supply interface 201 to different modules such as buildings, street lamps and vehicles, and lighting and power support of multiple areas can be easily achieved. This design not only enriches the expressive force of scenarios, but also reduces the disorder of power supply lines through the uniform distribution of the double-row matrix structure, making it easier for the user to manage.

In another possible implementation, an annular power supply interface 201 is designed on the surface of the expansion board 20, and 12 2P 0.8 mm puncture terminal female socket interfaces enclose a circle and are uniformly distributed on the edge of the expansion board 20. The design of the annular interfaces allows the user to connect a plurality of modules around the battery pack 10 and ensures that each module is evenly electrically supported by the annular arrangement. The design of the annular power supply interface 201 is suitable for scenarios where symmetric power supply is required. For example, when a circular or annular building block model is constructed, the user can connect a light module to each interface, so that the entire model can achieve a uniform lighting effect. For example, the lamp sets are evenly installed on the outer wall of one building block castle, and the lamp sets are connected through the annular power supply interfaces 201, so that an atmosphere with more immersion is created.

In another possible implementation, power supply interfaces 201 of various specifications are designed on the expansion board 20. In addition to a standard 2P 0.8 mm puncture terminal female socket interface, interfaces of 4P and 6P specifications are provided to support module connection with different power requirements. The 2P interface is used for low power modules, such as LED lamps; the 4P interface supports medium power devices, such as small sensors; and the 6P interface provides stable power for high power devices. The combined multi-specification interface design is suitable for a building block model scenario with complex functions. The user can choose interfaces of different specifications based on a requirement and allocate power reasonably. For example, in a multifunctional trolley model, the 2P interface is used to supply power to the lamp, the 4P interface provides power for a sensor module, and the 6P interface is connected to a main driving motor to ensure the driving force of the trolley. This multi-specification interface design enhances the functional diversity of the building block model, while improving the compatibility of the battery pack 10, making it easier for the user to flexibly match.

In another possible implementation, the power supply interface 201 not only supports power output, but also enables charging through a bidirectional power supply function, that is, power is input from an external power supply device to the power storage module 30 in the battery pack 10. A bidirectional power supply interface 201 is provided on the top of the expansion board 20, through which power is charged to the power storage module 30 when the user connects the battery pack 10 to an external power supply; and when the external power supply is not connected, the interface is automatically switched to an output mode to supply power to other modules. This design of the bidirectional power supply interface 201 is suitable for use in scenarios where the battery pack 10 needs to be charged frequently. For example, in a temporary display of building blocks, the user can directly connect the battery pack 10 to an external power source through the bidirectional interface to maintain a continuous charging state, ensuring uninterrupted power supply during the display. This design improves the use efficiency of the power supply interface 201 and facilitates the user to manage the power source.

Although the embodiments of the present invention have been described in detail with reference to the accompanying drawings, the embodiments of the present invention are not limited to the specific details of the above embodiments. Various simple modifications may be made to the technical solutions of the embodiments of the present invention within the technical idea of the embodiments of the present invention, and these simple modifications all belong to the protection scope of the embodiments of the present invention.

In addition, it should be noted that the specific technical features described in the foregoing specific implementations may be combined in any proper manner if there is no conflict. To avoid unnecessary repetition, the various possible combinations of the embodiments of the present invention are not further described.

Those skilled in the art may understand that all or some of the steps of the method in the foregoing embodiments may be implemented by a program instructing related hardware. The program is stored in a storage medium and comprises several instructions for instructing a single-chip microcomputer, a chip or a processor to perform all or some of the steps of the methods described in embodiments of the present application. The foregoing storage medium includes any medium that can store program code, such as a USB flash drive, a removable hard disk, a read-only memory (ROM), a random access memory (RAM), a magnetic disk, or an optical disc.

In addition, the various implementations of the embodiments of the present invention may also be combined, and the combination of various implementations should also be regarded as the disclosure of the embodiments of the present invention as long as the combination does not depart from the spirit of the embodiments of the present invention.

The invention claimed is:

1. An integrated building block, comprising:

a battery pack formed by splicing an upper shell and a lower shell, wherein outer surfaces of an upper end and a lower end of the battery pack are respectively provided with plug-in convex points and plug-in concave points with matched sizes;

a cavity is formed in the battery pack, and a power storage module and an expansion board are provided in the cavity; and the power storage module is provided with a power supply interface on an outer surface of the battery pack by the expansion board, and the power supply interface is used to supply power to a corresponding electric module after being butted with the corresponding electric module.

2. The integrated building block according to claim 1, wherein a power supply circuit is arranged between the power storage module and the expansion board.

3. The integrated building block according to claim 1, wherein screw posts arranged opposite to each other are provided in the upper shell and the lower shell and used to fix the upper shell and the lower shell after being spliced by screws.

4. The integrated building block according to claim 1, wherein a surface of the expansion board is further provided with a light sensor opening;

a light sensor is provided in the light sensor opening, and the light sensor serves as a trigger of a photosensitive switch; and the photosensitive switch is arranged on the expansion board and used to control the on-off of the power supply interface.

5. The integrated building block according to claim 4, wherein a surface of the expansion board is further provided with a toggle switch outlet;

a switch cap is provided in the toggle switch outlet, and the switch cap may be toggled along the toggle switch outlet and is used to trigger a manual switch; and the manual switch is arranged on the expansion board and used to cooperate with the photosensitive switch to control the on-off of the power supply interface.

6. The integrated building block according to claim 5, wherein switch states of the manual switch at least comprise manual on, manual off and automatic;

when the manual switch is set to on manually, the power supply interface is in a permanently on state;

when the manual switch is set to off manually, the power supply interface is in a permanently off state; and when the manual switch is automatic, the on-off state of the power supply interface is triggered by the photosensitive switch.

7. The integrated building block according to claim 1, wherein a surface of the expansion board is further provided with a charging hole; and the charging hole is provided with a charging interface connected to the power storage module and used to charge the power storage module when the charging module is electrically connected to the charging interface.

8. The integrated building block according to claim 6, wherein a surface of the expansion board is further provided with an indicator light hole; and an indicator light is provided in the indicator light hole and used to indicate whether the power storage module is in a charging state or not through the on/off state.

9. The integrated building block according to claim 1, wherein the power supply interface is a puncture terminal female socket interface.

10. The integrated building block according to claim 1, wherein a surface of the expansion board is further provided with at least one power supply interface hole; and each power supply interface extends out of a surface of the battery pack based on the power supply interface hole.

* * * * *